United States Patent [19]

Nakamats

[11] Patent Number: 4,696,397

[45] Date of Patent: Sep. 29, 1987

[54] CONTAINER FOR FLOPPY DISKS AND THE LIKE

[76] Inventor: Yoshiro Nakamats, 1-10-1105, Minami Apyama 5-chome, Minato-ku, Tokyo, Japan

[21] Appl. No.: 731,429

[22] Filed: May 7, 1985

[30] Foreign Application Priority Data

May 7, 1984 [JP] Japan ..... 59-89223

[51] Int. Cl.[4] ..... B65D 85/30

[52] U.S. Cl. ..... 206/444; 206/45.13; 206/45.21; 206/45.23; 206/425

[58] Field of Search ..... 206/444, 425, 45.21, 206/45.23, 45.13, 45, 44 B, 44.11, 268

[56] References Cited

U.S. PATENT DOCUMENTS

| | | | |
|---|---|---|---|
| 1,729,126 | 9/1929 | Reimer | 206/425 |
| 1,951,408 | 3/1934 | Haven | 206/425 |
| 3,910,487 | 10/1975 | Jaeschke | 206/425 |
| 4,111,299 | 9/1978 | Taub | 206/425 |
| 4,541,527 | 9/1985 | Nagel | 206/425 |
| 4,546,898 | 10/1985 | Ekuan | 206/425 |

*Primary Examiner*—Joseph Man-Fu Moy

*Attorney, Agent, or Firm*—Jordan and Hamburg

[57] ABSTRACT

The present invention provides a container for floppy disks and the like, including body and lid portions connected with each other, the longitudinal and transverse dimensions of the combined body and lid portions being larger than those of articles to be contained such as floppy disks and the like, the longitudinal dimension of the lid portion being smaller than those of the articles when the lid portion is opened as it is connected with the body portion, the body and lid portions being shaped to have the respective openings directed substantially in the same direction when the lid portion is opened as it is connected with the body portion, each of the body and lid portions being adapted to receive the articles, whereby different articles can be classified in the container.

12 Claims, 21 Drawing Figures

FIG. 17
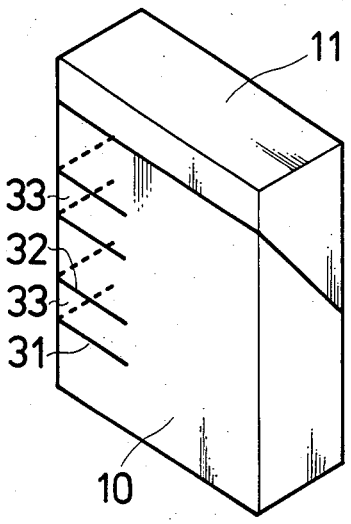
FIG. 18
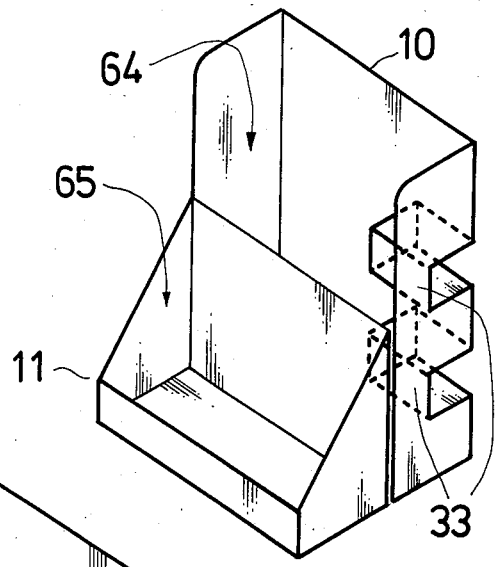
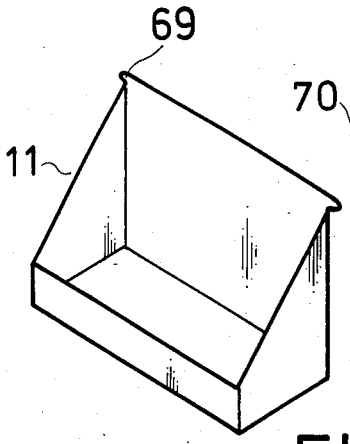
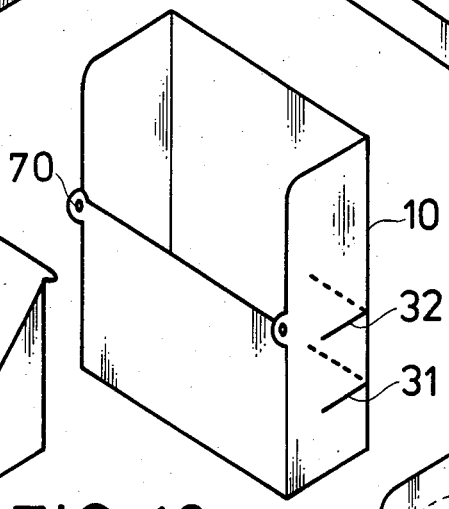
FIG. 19
FIG. 20
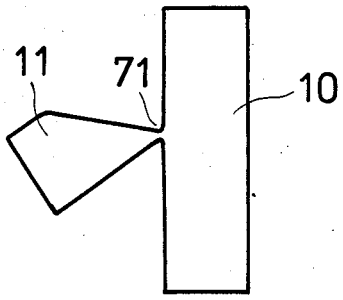
FIG. 21
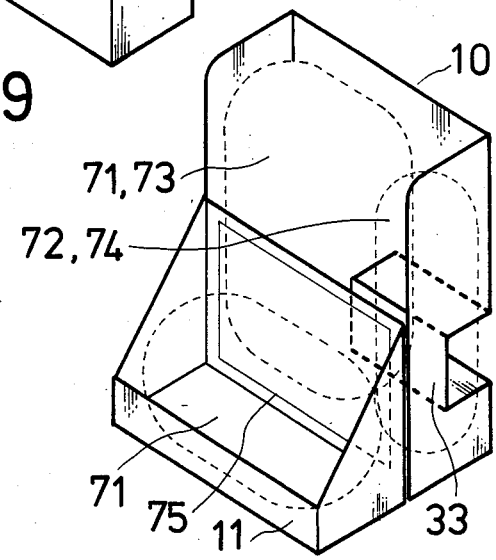

CONTAINER FOR FLOPPY DISKS AND THE LIKE

BACKGROUND OF THE INVENTION:

1. Field of the Invention:

The present invention relates to a container for containing floppy disks used as magnetic recording media in computers or a set including head cleaning diskettes and a bottle containing a cleaning liquid which is used to wet the head cleaning disketts.

2. Description of the Prior Art:

As shown in FIGS. 1 to 3, there is shown one of the prior art floppy disk containers which is in the form of a container 5 comprises a square box 1 containing a floppy disk 2 and a square box-shaped lid 3 fitted over the external sides of the square box 1 with the bottom wall thereof being engaged by the upper edge 4 of the box 1. Since the box and lid 1, 3 must separately fabricated and decorated, such a container is costly. The container 5 cannot be divided into a plurality of small chambers which are classified to various floppy disks such as used disks, unused disks, dictionary disks and work disks. Since the container 5 is so constructed that the bottom wall of the lid 3 is engaged by the upper edge 4 of the box by the upper edge of the contained floppy disk 2 is positioned below the upper edge 4 of the box 1 so that the floppy disk will not easily be removed from the box 1. The box and lid separately fabricated may easily be dispersed.

FIGS. 4 to 6 show the other of the prior art floppy disk containers 9 which comprises a square double-walled box 6 having an upper thin-wall portio and a lower thick-wall portion to define a step 7 and a lid 8 fitted over the upper portion of the box 6 and having a lower edge 8 adapted to engage the step 7 of the box 6. The separate box and lid also have been proposed to reduce cost, but be still expensive due to the double wall construction of the box 6. Similarly, the container 9 cannot be divided into a plurality of classifying chambers.

SUMMARY OF THE INVENTION:

It is an object of the present invention to provide a new and novel container construction overcoming all the above disadvantages in the prior art.

The present invention provides a floppy disk container comprising a body and lid connected with each other, the longitudinal and transverse dimensions of the combined body and lid being larger than those of each of articles to be contained, the longitudinal dimension of the lid being smaller than that of each article to be contained when the lid is opened as it is connected with the body, the body and lid being shaped to provide two openings directed substantially in the same direction when the lid is opened as it is connected with the body, whereby different articles such as floppy disks can separately be placed in the body and lid.

BRIEF DESCRIPTION OF THE DRAWINGS

FIGS. 17 and 18 are perspective views of a third embodiment according to the present invention;

FIG. 19 is a perspective view of a fourth embodiment of the present invention;

FIG. 20 is a side view of a fifth embodiment of the present invention; and

FIG. 21 is a perspective view of a sixth embodiment of the present invention.

DESCRIPTION OF PREFERRED EMBODIMENTS

Figure 1:
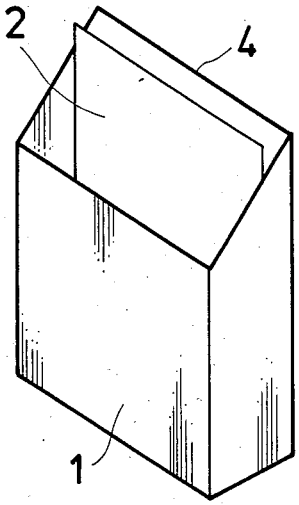
FIG. 1 PRIOR ART
FIGS. 1, 2 and 3 are perspective views illustrating one of the prior art container.
Figure 2:
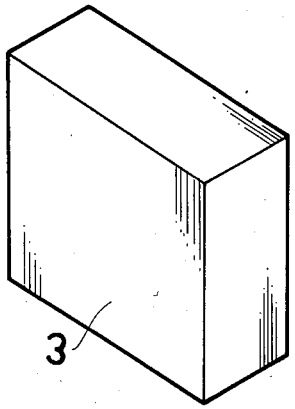
FIG. 2 PRIOR ART
Figure 3:
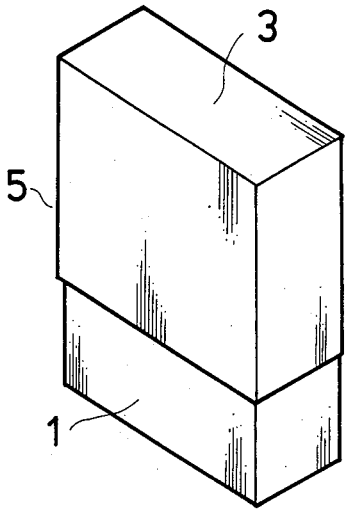
FIG. 3 PRIOR ART
Figure 4:
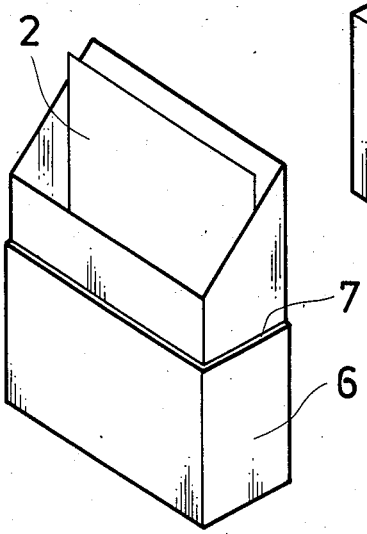
FIG. 4 PRIOR ART
FIGS. 4, 5 and 6 are perspective views illustrating the other of the prior art container.
Figure 5:
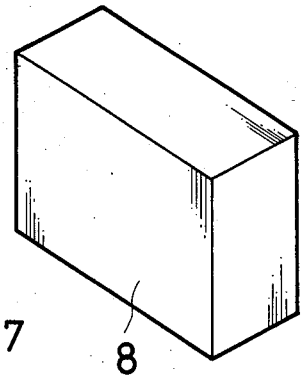
FIG. 5 PRIOR ART
Figure 6:
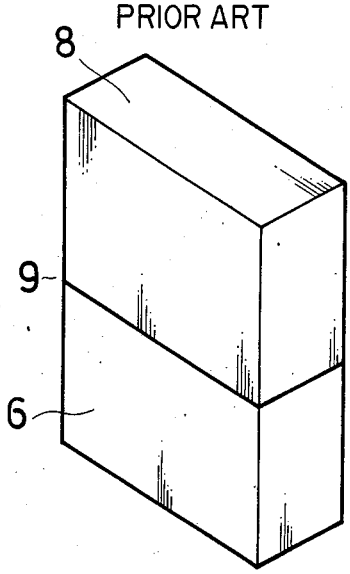
FIG. 6 PRIOR ART
Figure 7:
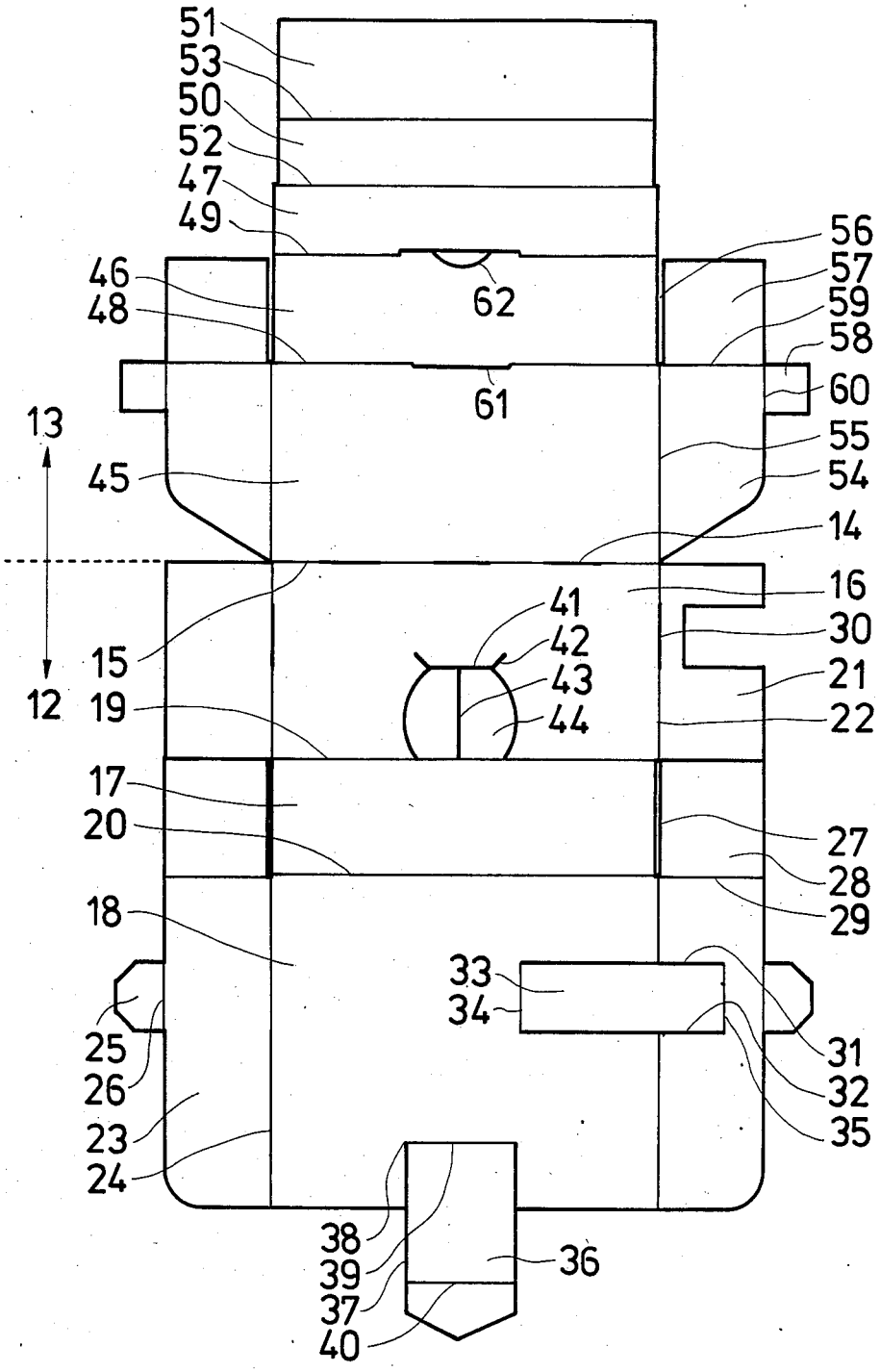
FIG. 7 is a plan view of a first embodiment of a container blank according to the present invention in its unfolded state.
Figure 8:
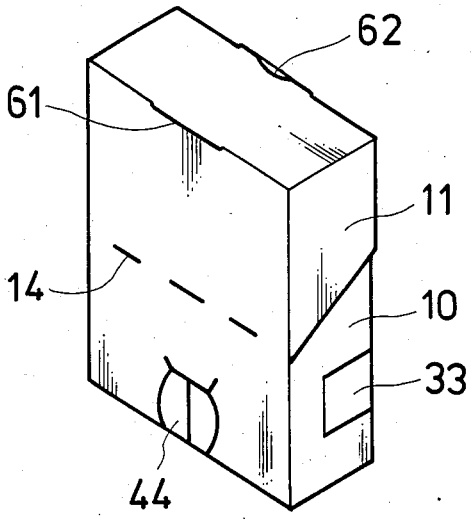
FIGS. 8, 9 and 10 are perspective views illsutrating the first embodiment of the present invention in its folded and used states.
Figure 9:
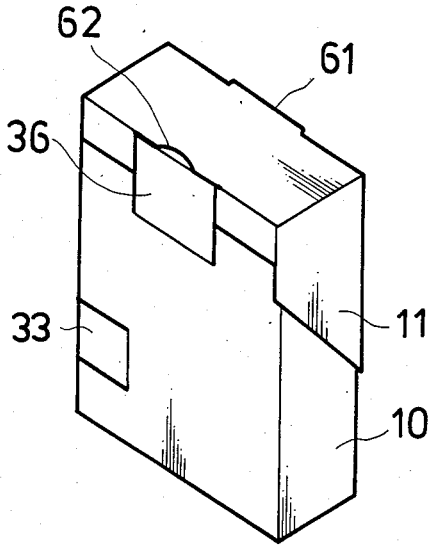

Referring first to FIG. 7, there is shown a container blank in a single stamped sheet form which is the first embodiment of the present invention. The container blank is folded into a container which comprises a square box-like portion 10 and a square box-like lid portion 11, these portions being integrally connected with each other, as shown in FIGS. 8 and 9. The body portion 10 can receive a cleaning diskette 2 vertically located therein.

The container blank of FIG. 7 is made of any foldable sheet material such as cardboard or the like and comprises a body section 12 and a lid section 13 which are connected with each other through an inwardly folding line 15 interrupted by cuttings 14.

The body section 12 includes a forward wall 16 directly connected with the folding line 15, a bottom wall 17 connected with the forward wall 16 through an outwardly folding line 19 and a rearward wall 18 connected with the bottom wall 17 through an outwardly folding line 20. Folded-in flaps 21 are connected with the opposite sides of the forward wall 16 through outwardly folding lines 22, respectively. Side flap 23 is connected with each side of the rearward wall 18 through an outwardly folding line 24. Each of the side flaps 23 includes an insertion flap 25 connected therewith through an outwardly folding line 26 and a folded-in flap 28 connected therewith through an outwardly folding line 29. Each of the folded-in flap 28 is separated from the bottom wall 17 through a cutting 27. The bottom wall 17, the side flaps 23 and the folded-in flaps 21 are identical in width. Each of the outwardly folding lines 22 includes a cutting 30 which is spaced apart from the bottom wall 17 by a distance equal to the distance between the bottom wall 17 and the insertion flap 25. Each of the insertion flaps is inserted into the corresponding cutting 30 on assembling.

Parallel cuttings 31 and 32 of the same length are provided across one of the outwardly folding lines 24 to form a frame piece 33. The frame piece 33 terminates outwardly folding lines 34 and 35.

The rearward wall 18 includes a tongue 36 formed therein at the center of the free edge. The tongue 36 has a base in the form of an inwardly folding line 39 which connects the inner ends 38 of cuttings 37 with each other. The outer end of the tongue 36 has an outwardly folding line 40.

The forward wall 16 includes a pair of insertion flaps 44 separated from each other through a cutting 43. Each of the insertion flaps 44 is defined by a substantially U-shaped cutting 41 extending from the folding line 19 and a slant cutting 42 extending from the opposite end of the U-shaped cutting 41.

The lid section 13 comprises a forward wall 45 directly connected with the inwardly folding line 15, a top wall 46 connected with the forward wall 45 through an outwardly folding line 48 and a rearward wall 47 connected with the top wall 46 through an outwardly folding line 49. The rearward wall 47 also is connected with a folded-in flap 50 through an outwardly folding line 52. The folded-in flap 50 is in turn connected with a folded-in flap 51 through an inwardly folding line 53. Side flaps 54 are connected with the opposite sides of the forward wall 45 through outwardly folding lines 55, respectively. Each of the side flaps 54 inludes a foldedin flap 57 connected therewith through an outwardly folding line 59 and separated from the top wall 46 through a cutting 56, and a side folded-in flap 58 connected with the outer side of the side flap 54 through an outwardly folding line 60. Each of the side flaps 54 and top wall 46 has a width equal to that of the bottom wall 17.

The outwardly folding line 48 includes a cutting 61 formed therein at the central position into which the aforementioned insertion flap 44 is to be fitted. The outwardly folding line 49 has a central cutting 62 for receiving the tongue 36, this cutting having an arcuate opening.

On assemling, foldings are first effected along the folding lines 20, 24, 29 and 26 and the subsequent foldings are made along the folding lines 19 and 22 with the insertion flap 25 being inserted into the cutting 30 to form the body portion 10.

Subsequently, foldings are effected along the folding lines 55, 59 and 60 and then along the folding lines 48, 49 and 52 to form the profile of the lid 11. A folding is made along the folding line 53 during which the folded-in flaps 50 and 51 are pressed onto the folded-in flaps 57 folded in the lid so that the folded-in flaps 58 will be enclosed by the folded-in flaps 50 and 51. The folded-in flaps 50 and 51 are then closely engaged by the back-faces of the folded-in flaps 57, 58 and top wall 46 to form a complete lid 11. When the tongue 36 is folded along the folding lines 39 and 40 and then inserted into the cutting 62, this tongue 36 serves as a latch for the lid 11. Thus, a closed container is completed as shown in FIG. 8.

Figure 10:
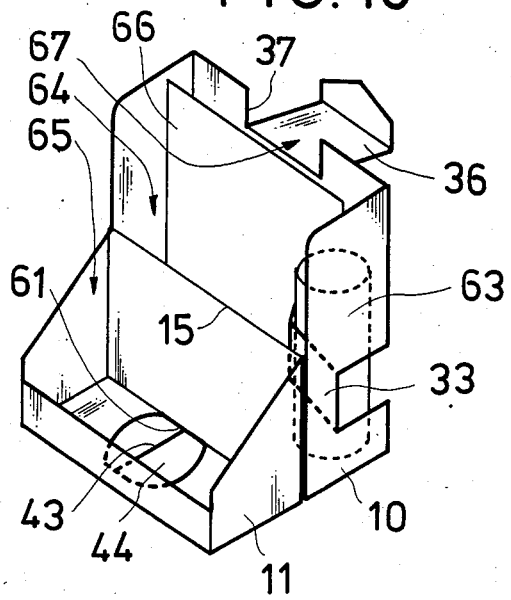
Figure 11:
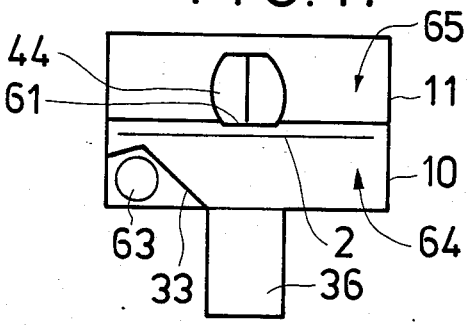
FIG. 11 is a top view of FIG. 10.

The frame piece 33 may be pressed inwardly as shown in FIGS. 10 and 11. The frame piece 33 is folded in along the folding lines 34 and 35 and then protrudes into the body portion 10 to form a frame for resiliently holding a longitudinally elongated article such as a cleaning liquid bottle 63.

Figure 12:
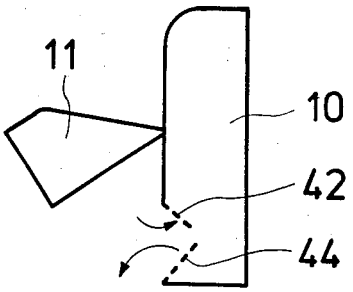
FIG. 12 is a side view showing the container of FIGS. 8 through 11 in another state.
Figure 13:
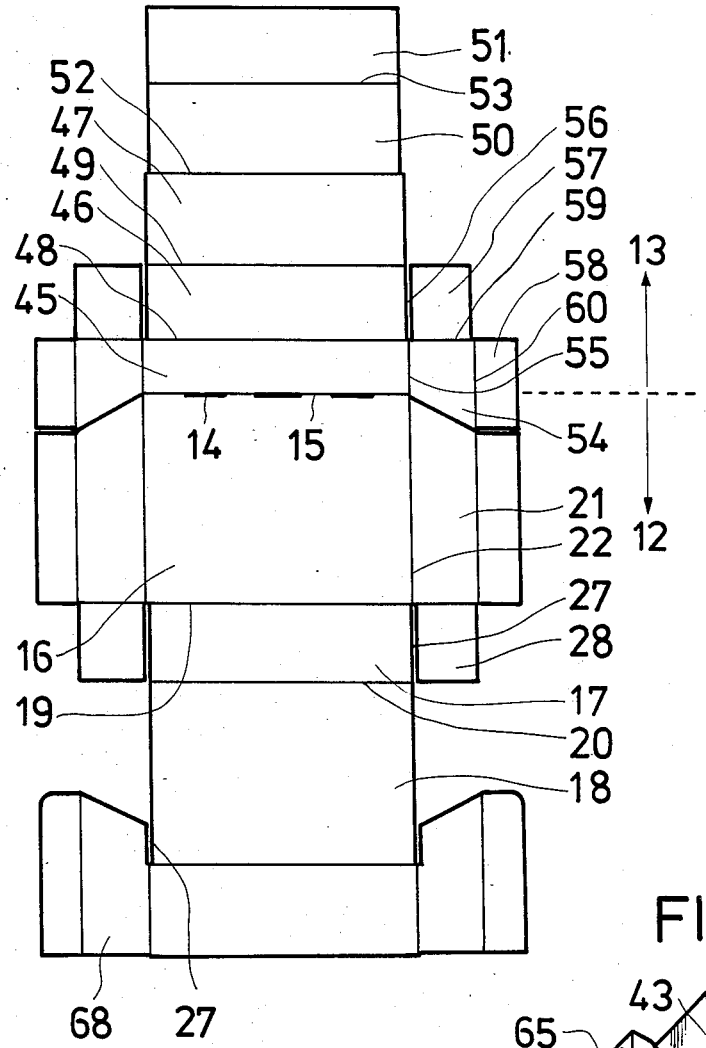
FIG. 13 is a plan view showing a second embodiment of the container according to the present invention in its unfoled state.
Figure 14:
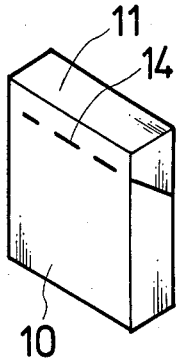
FIGS. 14, 15 and 16 are perspective views showing the second embodiment of FIG. 13 in its folded and used states.
Figure 15:
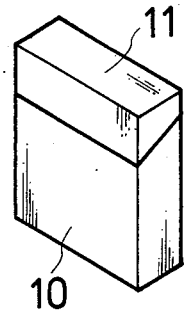
Figure 16:
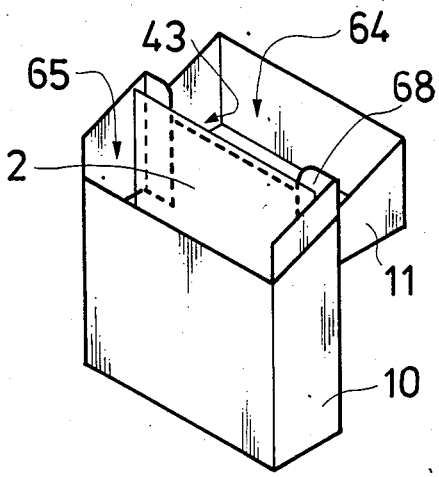

When the tongue 37 is pulled out and folded along the folding line 15 to open the lid 11, the body and lid portions 10 and 11 are fixed to each other by depressing the marginal edges of the insertion flaps 44 to open the cuttings 42 as shown in FIG. 12 and by pulling out and inserting the insertion flaps 44 into the cutting 61 as shown in FIG. 10. Since there is the central cutting 43 between the insertion flaps 44, they can be overlapped when inserted into the cutting 61. Thereafter, the insertion flaps 44 are expanded from each other to provide a stronger connection.

Thus, the body and lid portions 10 and 11 can be arranged to provide two openings 64 and 65 directed in the same direction through which various articles such as a cleaning diskette 66 and a cleaning liquid bottle 63 can be contained in the container.

Since the tongue 36 has cuttings 37 on the opposite sides, it may be pulled out and foled through an angle of 90 degrees to form a notch 67 on the rearward wall 18 as shown in FIG. 10. Such a notch 67 may be utilized such that the cleaning diskette 66 will be removed easily by holding it between operator's fingers.

In the opened state of FIG. 10, the container is divided into two chambers, that is, the body portion 10 and the lid portion 11. For example, the body portion 10 may receive unused cleaning diskettes 66 and a cleaning liquid bottole 63 held in place by the frame piece 33. The lid portion 11 may receive used cleaning diskettes. Furthermore, the lid portion 11 serves as a stand for steadily holding the body portion 10 in its upright state.

FIGS. 13 through 16 show the second embodiment of the present invention in which the container includes partition flaps 68 formed therein in place of the frame piece 33 and tongue 36 as in the first embodiment. The partition flaps can support floppy disks 2 in the lid portion 11 and completely separate the same floppy disks from different floppy disks contained in the body portion 10. Furthermore, a recess 43 is located between the partition flaps 68 such that the floppy disks may easily be removed from both the body and lid portions through this recess 43.

FIGS. 17 and 18 shows the third embodiment of the present invention in which the interior of the container is divided vertically into at least two steps.

FIG. 19 shows the fourth embodiment of the present invention in which the body and lid portions 10 and 11 are separately molded from any plastic material. The body portion 10 inclues pin-shaped portions 69 formed thereon and the lid portion 11 includes bearings 70 formed thereon for receiving the respective pin-shaped portions 69. Thus, the lid portion 11 may be pivoted relative to the body portion 10.

FIG. 20 shows the fifth embodiment of the present invention in which the body and lid portions 10 and 11 are molded integrally from any suitable plastic material such as polypropylene and the like. The lid portion 11 is connected with the body portion 10 through a flexible connection 71.

As shown in FIG. 21, the present invention can provide a display container or lunch box in which the body portion 10 receives an article such as a hamburger, a sandwitch, a fried chicken or the like as denoted by 71. Another article such as French fries, a sauce bottle or the like as designated by 72 is lcoated between the folded frame piece 33 and the inner wall of the body portion. Alternatively, the body portion 10 receives a puff 73 with a lip stick, a cream bottle or the like as denoted by 74 being located between the folded frame piece 33 and the inner wall of the body portion 10. The lid portion 11 may receive a mirror 74.

The container according to the present invention may be used to store, use or classify the conventional floppy disks if the frame piece 33 is folded in or if there is no frame piece.

The present invention has the following advantages:

(1) By stamping a single sheet of blank from which body and lid portions can simultaneously be assembled, the container may be fabricated with an extremely reduced cost. For example, the container may be produced with a cost of only 18 yens which is one twelveth less than 280 yens in the prior art.

(2) Since the lid portion is used as a classifying pocket, the container according to the present invention is very convenient in use.

(3) Since the lid serves as a support for standing the body as shown in FIG. 10, the floppy disks may be used even in smaller spaces. The lid and body portions may positively be connected with each other by the use of the insertion flaps 44.

(4) Since the container according to the present invention is assembled from a single sheet, it may be expanded or flattened on storing or being not used. As a result, the storage cost and space may be reduced without bulkiness.

(5) Where the edge of the opening in the body is provided with a notch, floppy disks, cards or cigarets contained in the container may easily be removed therefrom. Since the lid is widely opened through the latch portion, the contents may more easily be removed from the container.

(6) The folded frame piece may divide the interior of the body into two chambers which can respectively receive different articles, for example, flat disks and a cylindrical cleaning liquid bottle.

I claim:

1. A container for articles such as floppy disks and the like comprising a body and a lid, pivotal means pivotably connecting said lid to said body, said body having a bottom wall and a front wall connected to said bottom wall, said lid having a top wall and a front wall connected to said top wall, the container having a closed position in which said top wall overlies said bottom wall and the front wall of said lid forms a generally coplanar continuation of the front wall of said body, the container having an open position in which the lid is pivoted from said closed position 180° about said pivotal means to locate the front wall of said lid side-by-side and parallel to the front wall of the body such that both the body and the lid open upwardly to receive said articles in the body and in the lid, and latch flap means on said body and said lid which are interengaged when said lid is in its open position to latch said body and lid together in said open position, whereby the body and lid are latched to one another by said latch flap means while both the body and lid are open at the top to receive articles therein, said latch flap means comprising a latch flap section formed on said front wall of said body and defined by a latch flap cut line and a latch flap fold line such that the latch flap section can be pivoted along said latch flap fold line between a non-latching position in which the latch flap section is coplanar with said front wall of said body and a latching position in which the latch flap section extends generally perpendicularly to said front wall of said body, said latch flap means further comprising a cut line in said lid for receiving said latch flap section when the latter is in said latching position to thereby latch said lid to said body.

2. A container according to claim 1, wherein said front wall of said lid is joined to said top wall of said lid along a front-top wall fold line, said cut line in said lid being contiguous with said front-top wall fold line.

3. A container according to claim 2, wherein said front wall of said body is joined to said bottom wall of said body along a front-bottom wall fold line, said latch flat fold line being contiguous with said front-bottom wall fold line.

4. A container according to claim 3, wherein said latchflap cut line comprises a first latch-flap cut line section which is parallel to said front-bottom wall fold line, and second, third and fourth latch-flap cut lines sections extending between said first latch-flap cut line section and said front-bottom wall fold line to thereby define a latch flap section having two latch-flap parts with one latch-flap part being defined by said second and third latch-flap cut line sections and a portion of said first latch-flap cut line section and the other latch flap part is defined by said third and fourth latch-flap cut line sections and another portion of said first latch-flap cut line section.

5. A container according to claim 4, wherein said third latch-flap cut line section extends perpendicular to said first latch flap cut line section.

6. A container according to claim 5, wherein said second and fourth latch-flap cut line sections have an arcuate configuration such that the greatest distance between said second and fourth latch-flap cut line sections is generally midway between the first latch-flap cut line section and said front-bottom wall fold line, said greatest distance being greater than the length of said cut line in said lid.

7. A container according to claim 6, wherein said latchflap cut line further comprises fifth and sixth latch-flap cut line sections extending at an obtuse angle from the ends of said first latch-flap cut line section.

8. A container according to claim 1, wherein the front wall of said body and the front wall of said lid have the same height such that when the container is in said open position, said top wall forms a generally coplanar continuation of said bottom wall.

9. A container according to claim 1, wherein said body further comprises a rear wall and a side wall joined to one another along a corner line, first parallel cut lines in said rear wall extending perpendicularly from said corner line to a first fold line in said rear wall which is parallel to said corner line, second parallel cut lines in said side wall extending perpendicularly from said corner line to a second fold line in said side wall which is parallel to said corner line, said first and second parallel cut lines and said first and second fold lines defining a foldable band member which is foldable about said first and second fold lines and said corner line to an inwardly folded position disposed within the body of the box for holding longitudinally elongated articles within an internal space bounded by said inwardly folded band member and said rear and side walls.

10. A container according to claim 1, wherein said body and said lid are formed from a single sheet of sheet material, said pivotal means being defined by a fold line in said single sheet of sheet material.

11. A container according to claim 1, wherein said body and said lid are separately formed, and pivotal means pivotally connecting said lid to said body.

12. A container for articles in which the container is supportable on an underlying flat support surface, comprising a body and a lid, pivotal means pivotably connecting said lid to said body, said body having a bottom wall and a front wall connected to said bottom wall, said lid having a top wall and a front wall connected to said top wall, the container having a closed position in which said top wall overlies said bottom wall and the front wall of said lid forms a generally coplanar continuation of the front wall of said body, the container having an open position in which the lid is pivoted from said closed position 180° about said pivotal means to locate the front wall of said lid side-by-side and parallel to the front wall of the body such that both the body and the lid open upwardly to receive said articles in the body and in the lid, said front walls of said body and lid having the same height such that when the container is in said open position, the top wall forms a generally coplanar continuation of said bottom wall, and latch flap means on said body and said lid which are interengaged when said lid is in its open position to latch said body and lid together in said open position, said latch flap means compirising a latch flap section formed on said front wall of said body and defined by a latch flap cut line and a latch flap fold line such that the latch flap section can be pivoted along said latch flap fold line between a non-latching position in which the latch flap section is coplanar with said front wall of said body and a latching position in which the latch flap section extends generally perpendicularly to said front wall of said body, said latch flap means further comprising a cut line in said lid for receiving said latch flap section when the latter is in said latching position to thereby latch said lid to said body, whereby the open container is supported in its open position on an underlying flat support surface which is engaged both by the bottom wall of the body and the top wall of the lid as the body and lid are latched to one another by said latch flap means and both the body and lid are open at the top to receive articles therein.

* * * * *